US007567226B2

(12) United States Patent
Choi

(10) Patent No.: US 7,567,226 B2
(45) Date of Patent: Jul. 28, 2009

(54) METHOD AND APPARATUS FOR DRIVING A PLASMA DISPLAY PANEL

(75) Inventor: Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 434 days.

(21) Appl. No.: 10/853,717

(22) Filed: May 26, 2004

(65) Prior Publication Data

US 2004/0251845 A1 Dec. 16, 2004

(30) Foreign Application Priority Data

May 27, 2003 (KR) ..... 10-2003-0033777

(51) Int. Cl.
*G09G 3/28* (2006.01)

(52) U.S. Cl. ..... 345/68; 345/690; 315/169.1; 315/169.2; 315/169.4

(58) Field of Classification Search ..... 345/60–63, 345/66–68, 690; 315/169.1–169.4
See application file for complete search history.

(56) References Cited

U.S. PATENT DOCUMENTS

| | | | | |
|---|---|---|---|---|
| 6,243,084 | B1 * | 6/2001 | Nagai | 345/210 |
| 7,015,648 | B2 * | 3/2006 | Son et al. | 315/169.4 |
| 7,138,966 | B2 * | 11/2006 | Shindo et al. | 345/63 |

FOREIGN PATENT DOCUMENTS

| | | | |
|---|---|---|---|
| JP | 2001-265280 | | 9/2001 |
| KR | 10-2001-0091213 | A | 10/2001 |
| KR | 10-2002-0019853 | A | 3/2002 |
| KR | 10-2002-0061911 | A | 7/2002 |
| KR | 10-2002-0066274 | A | 8/2002 |
| KR | 1020020066274 | | 8/2002 |
| KR | 10-2004-056010 | A | 6/2004 |
| KR | 10-2004-0056047 | A | 6/2004 |
| KR | 10-2004-0056422 | A | 7/2004 |

OTHER PUBLICATIONS

Korean Office Action dated Mar. 28, 2005.

* cited by examiner

*Primary Examiner*—Henry N Tran
(74) *Attorney, Agent, or Firm*—KED & Associates, LLP

(57) ABSTRACT

The present invention relates to a method and apparatus for driving a plasma display panel (PDP) for reducing an address period and stabilizing discharge. The method for driving the PDP includes a first step of, during the address period, supplying a scan voltage to the scan electrodes and a data voltage to the address electrodes to select a cell, and supplying a DC bias voltage to the sustain electrodes; a second step of, between the address period and the sustain period, lowering a voltage of the scan electrodes and maintaining a voltage on the sustain electrodes in the DC bias voltage; and a third step of during the sustain period, alternately applying a sustain pulse to the scan electrodes and the sustain electrodes to generate sustain discharge.

12 Claims, 8 Drawing Sheets

METHOD AND APPARATUS FOR DRIVING A PLASMA DISPLAY PANEL

This Nonprovisional application claims priority under 35 U.S.C. § 119(a) on patent application No. 10-2003-0033777 filed in Korea on May 27, 2003, the entire contents of which are hereby incorporated by reference.

BACKGROUND OF THE INVENTION

1. Field of the Invention

The present invention relates to a plasma display panel, and more particularly, to a method and apparatus for driving a plasma display panel, which can reduce an address period and stabilizes discharge.

2. Description of the Background Art

In a plasma display panel (hereinafter, referred to as "PDP"), fluorescent materials are emitted by ultraviolet rays of 147 nm that are generated upon discharge of He+Xe or Ne+Xe gas to display an image including characters or graphics. Such a PDP can be easily made thin and large and can provide a high image quality with the recent development of the relevant technology. In particular, in a three-electrode AC surface discharge type PDP, a voltage required for discharge is lowered using wall charges accumulated on the surface upon discharge and electrodes are protected from sputtering occurring due to the discharge. It has advantages of low-voltage driving and long-life.

Referring to FIG. 1, a discharge cell of a three-electrode AC surface discharge type PDP includes a scan electrode 30Y and a sustain electrode 30Z formed on an upper substrate 10, and an address electrode 20X formed on a lower substrate 18.

The scan electrode 30Y and the sustain electrode 30Z includes transparent electrodes 12Y and 12Z, and metal bus electrodes 13Y and 13Z, which have a line width smaller than that of the transparent electrodes 12Y and 12Z and are formed at one edges of the transparent electrodes, respectively. The transparent electrodes 12Y and 12Z are usually formed on the upper substrate 10 using ITO (indium-tin-oxide).

The metal bus electrodes 13Y and 13Z are usually formed on the transparent electrodes 12Y and 12Z using chrome (Cr) and serve to reduce a drop in a voltage due to the transparent electrodes 12Y and 12Z having high resistance. An upper dielectric layer 14 and a protection film 16 are stacked on the upper substrate 10 on which the scan electrode 30Y and the sustain electrode 30Z are stacked.

Wall charges generated at the time of plasma discharge are accumulated on the upper dielectric layer 14. The protection film 16 serves to protect the upper dielectric layer 14 from the sputtering occurring during the plasma discharge and to increase discharge efficiency of a secondary cell. The protection film 16 is usually formed using magnesium oxide (MgO).

The address electrode 20X is formed in a direction that intersects the scan electrode 30Y and sustain electrode 30Z. A lower dielectric layer 22 and a diaphragm 24 are formed on the lower substrate 18 in which the address electrode 20X is formed. A fluorescent layer 26 is formed on the surface of the lower dielectric layer 22 and diaphragms 24. The diaphragms 24 are formed in parallel to the address electrode 20X to physically divide the discharge cell, and serve to prevent ultraviolet rays and a visible ray generated due to the discharge from leaking toward neighboring discharge cells. The fluorescent layer 26 is excited by ultraviolet rays generated during the plasma discharge to generate a visible ray of one of red, green and blue. An inert mixed gas such as He+Xe or Ne+Xe for discharge is inserted into the discharge space of the discharge cell provided between the upper and lower substrates 10 and 18 and the diaphragms 24.

Such a three-electrode AC surface discharge type PDP is driven in such a way that one frame is divided into several sub fields of different emission numbers in order to implement the gray level of an image. Each sub field is divided into a reset period for uniformly generating discharge, an address period for selecting a discharge cell, and a sustain period for implementing the gray level according to the number of discharge. If an image is to be represented using 256 gray levels, a frame period (16.67 ms) corresponding to 1/60 second is divided into 8 sub fields SF1 to SF8, as shown in FIG. 2.

Each of the 8 sub fields SF1 to SF8 is divided into the reset period, the address period and the sustain period. The reset period and the address period of each sub field are the same every sub field, whereas the sustain period and its discharge number increase in the ratio of 2n (n=0,1,2,3,4,5,6,7) in each sub field. Since the sustain periods becomes different in respective sub fields as such, the gray level of the image can be implemented.

The driving method of such a PDP is mainly classified into a selective writing mode and a selective erasing mode according to whether the discharge cell selected by address discharge is emitted.

In the selective writing mode, all of cells are turned off during the reset period and on-cells to be turned on are selected during the address period. Further, in the selective writing mode, discharge of the on-cells selected by address discharge is maintained during the sustain period, so that an image is displayed.

In the selective erasing mode, all of cells are turned on during the reset period and off-cells to be turned off are selected during the address period. Moreover, in the selective erasing mode, discharge of on-cells except for the off-cells selected by address discharge are kept during the sustain period, so that an image is displayed.

The selective writing mode has an advantage that it has a gray representation level wider than that of the selective erasing mode, but has a disadvantage that its address period is longer than that of the selective erasing mode. On the contrary, the selective erasing mode is advantageous in high-speed driving but is disadvantageous in the contrast property compared to the selective writing mode since all the cells are turned on during the reset period being a non-display period.

A so-called "SWSE mode having better advantages than the selective writing mode and the selective erasing mode was proposed in Korean Patent Application Nos. 10-2000-0012669, 10-2000-0053214, 10-2001-0003003, 10-2001-0006492, 10-2002-0082512, 10-2002-0082513, 10-2002-0082576 and so one, all of which were applied by the present applicant. An example of a driving signal of the SWSE mode is shown in FIG. 3.

Referring to FIG. 3, in the SWSE mode, the PDP is driven with one frame period time-divided into a plurality of selective writing sub fields SW and a plurality of selective erasing sub fields SE.

During the reset period of the selective writing sub fields SW, a ramp waveform (Ruy) of rising inclination where a voltage increases up to a setup voltage (Vsetup) is applied to all scan electrodes Y. At the same time, 0V or the ground voltage GND is applied to the sustain electrodes Z and the address electrodes X. Writing dark discharge occurs within cells of the entire screen between the scan electrodes Y and the address electrodes X and between the scan electrodes Y and the sustain electrodes Z by means of the rising ramp waveform (Ruy).

Wall charges of the positive polarity (+) are accumulated on the address electrodes X and the sustain electrodes Z and wall charges of the negative polarity (−) are accumulated on the scan electrodes Y, by means of the writing dark discharge. After the writing dark discharge, a ramp waveform (Rdy) of falling inclination where a voltage decreases from the sustain voltage (Vs) to the negative polarity voltage is applied to the scan electrodes Y. At the same time, a DC bias voltage (DCz) of the sustain voltage (Vs) is applied to the sustain electrodes Z.

Erasing dark discharge occurs between the scan electrodes Y and the sustain electrodes Z and between the scan electrodes Y and the address electrodes X because of a voltage difference between the falling ramp waveform (Rdy) and the DC bias voltage (DCz). The erasing dark discharge serves to erase excessive wall charges that do not contribute to the address discharge among the wall charges generated by the rising ramp waveform (Rdy), so that the wall charges uniformly remain within the cells of the entire screen.

During the address period of the selective writing sub fields SW, a writing scan pulse (scw) is sequentially applied to the scan electrodes Y and a writing data pulse (dw) synchronized to the writing scan pulse (scw) is applied to the address electrodes X. Further, a DC bias voltage (DCz) is continuously applied to the sustain electrodes Z.

As the voltage difference between the writing scan pulse (scw) and the writing data pulse (dw) and the wall voltage initialized during the reset period are added, writing discharge occurs within the on-cells to which the writing data pulse (dw) is applied. While wall charges of the positive polarity are being accumulated on the scan electrodes Y by means of the writing discharge, the polarity of the wall charges is reversed to the positive polarity and wall charges of the negative polarity are accumulated on the sustain electrodes Z and the address electrodes X.

During the sustain period of the selective writing sub fields SW, a sustain pulse (sus) of a sustain voltage (Vs) is alternately applied to the scan electrodes Y and the sustain electrodes Z. Whenever the sustain pulse (sus) is supplied as such, sustain discharge is generated in the on-cells during the writing address period.

After the last sustain discharge is generated, an erasing ramp waveform(ers) that gradually rises up to the sustain voltage (Vs) is applied. The wall charges generated by the sustain discharge are erased, while the erasing discharge occurs within the on-cells, by means of the erasing ramp waveform(ers).

During the address period of the selective erasing sub fields SE, an erasing scan pulse (sce) is sequentially applied to the scan electrodes Y, and an erasing data pulse (de) synchronized to the erasing scan pulse (sce) is applied to the address electrodes X. During the address period, 0V or a ground voltage GND is applied to the sustain electrodes Z. As a voltage difference between the scan pulse (sce) and the erasing data (de) and the wall voltage within the cells are added, erasing discharge is generated within the off-cells to which the erasing data pulse SED is applied. By means of the erasing discharge, the wall charges within the off-cells are erased to the extent that discharge does not occur although the sustain voltage is applied thereto.

During the sustain period of the selective erasing sub fields SE, the sustain pulse (sus) of the sustain voltage (Vs) is alternately applied to the scan electrodes Y and the sustain electrodes Z. Whenever the sustain pulse (sus) is applied, sustain discharge occurs in the on-cells that are not selected during the erasing address period.

The biggest difference between the selective writing sub fields SW of the SWSE mode and the selective erasing sub fields SE is the address discharge properties. In the selective writing sub fields SW, strong reversion is necessary since the wall charge polarity on the scan electrodes Y and the sustain electrodes Z has to be inversed or reversed by means of address discharge within the on-cells that generate sustain discharge.

For this reason, since an address discharge time necessary to generate the writing address discharge is relatively long, the address period becomes long. On the contrary, in the selective erasing sub fields SE, the wall charge polarity on the scan electrodes Y and the sustain electrodes Z is not inversed but the amount of the wall charges is reduced. Due to this, since the address discharge time for generating the erasing address discharge becomes short compared to the writing address discharge, the address period can be relatively shortened.

The driving method of the PDP, however, has problems that the address period is long and discharge is unstable in a low gray level because of delayed address discharge. If the address period becomes long, the sustain period is relatively shortened during a limited frame period, thus making luminance degrade. As a result, it is difficult to add more sub fields during one frame period in order to reduce factors of lowering in image quality such as motion picture quasi-contour noise.

Discharge instability in the low gray level will now be described in detail. Generally, the number of the sustain pulse and the number of discharge are not coincident each other. Discharge is unstable when the sustain pulse is generated initially. After that, when the sustain pulse is generated, luminance increases while discharge is gradually stabilized. In other words, when the sustain pulse is generated initially, discharge may not happen. Accordingly, as the number of consecutive sustain pulse is small in the low gray level, discharge is difficult to occur in a stable state.

SUMMARY OF THE INVENTION

Accordingly, an object of the present invention is to solve at least the problems and disadvantages of the background art.

An object of the present invention is to provide a method and apparatus for driving a PDP, which can reduce an address period and stabilize discharge.

To achieve the above objects, according to the present invention, there is provided a method for driving a PDP, including: a first step of, during the address period, supplying a scan voltage to the scan electrodes and a data voltage to the address electrodes to select a cell, and supplying a DC bias voltage to the sustain electrodes; a second step of, between the address period and the sustain period, lowering a voltage of the scan electrodes and maintaining a voltage on the sustain electrodes in the DC bias voltage; and a third step of, during the sustain period, alternately applying a sustain pulse to the scan electrodes and the sustain electrodes to generate sustain discharge.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the accompanying FIG. 4 to FIG. 8.

Figure 4:
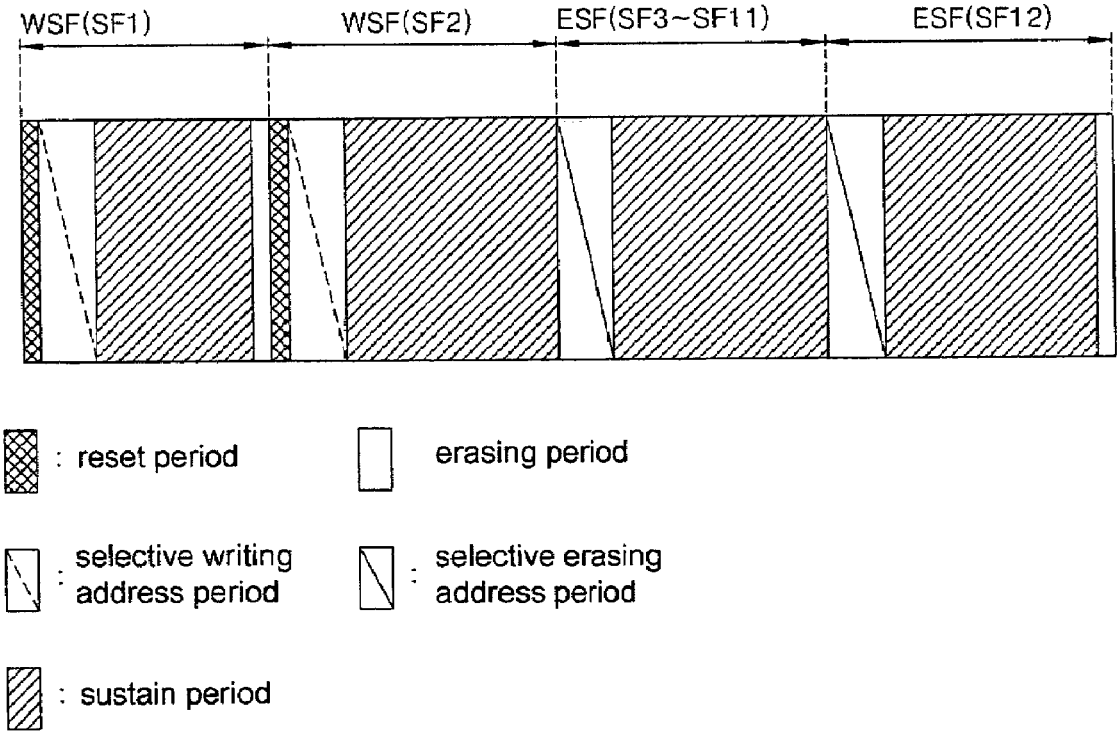
FIG. 4 shows a sub field pattern according to an embodiment of the present invention.

Referring to FIG. 4, in a method for driving a PDP according to an embodiment of the present invention, the PDP is driven in such a manner that one frame period is time-divided into a selective writing sub field (WSF) including first and second sub fields SF1 and SF2 of a low gray level and a selective erasing sub field (ESF) including third to twelfth sub fields SF3 to SF12.

The first sub field SF1 includes a reset period wherein wall charges of the positive polarity in cells of the entire screen is uniformly formed, a writing address period wherein an on-cell is selected using writing discharge, a sustain period wherein sustain discharge for the selected on-cell is selected, and an erasing period wherein wall charges remaining in the cell are erased by means of sustain discharge. The second sub field SF2 being the last sub field of the selective writing sub field (WSF) includes the reset period, the writing address period and the sustain period except for the erasing period.

Each of the third to eleventh sub fields SF3 to SF11 includes an erasing address period wherein an off-cell is selected by means of erasing discharge and a sustain period wherein sustain discharge for an on-cell is generated. The twelfth sub field SF12 being the last sub field of the selective erasing sub field (ESF) includes the erasing address period and the sustain period and further includes the erasing period at the last stage.

A luminance weight assigned to each of the sub fields SF1 to SF12 is assigned as follows.

The luminance weight of the first sub field SF1 is assigned with 20(1), the luminance weight of the second sub field SF2 is assigned with 21(2), the luminance weight SF3 of the third sub field is assigned with 22(4), the luminance weight of the fourth sub field SF4 is assigned with 23(8) and the luminance weight of the fifth sub field SF5 is assigned with 24(16). The luminance weights of the sixth to twelfth sub field SF6 to SF12 are assigned with 25(32), respectively.

The first and second sub fields SF1 and SF2 being the selective writing sub field (WSF) represent the gray level by means of binary coding that does not depend on the previous cell state. On the contrary, the third to twelfth sub fields SF3 to SF12 being the selective erasing sub field (ESF) represent the gray level by means of linear coding that selects an off-cell among on-cells that are turned on in the previous sub field.

Only the first and second sub fields SF1 and SF2 of such a low luminance weight are set as the selective writing sub field SF1, and the remaining sub fields SF3 to SF12 are set as the selective erasing sub fields SF3 to SF12.

In the method and apparatus for driving the PDP according to the present invention, the number of the selective writing sub field (WSF) whose address period is relatively long among the sub fields positioned in one frame period is 2; the first and second sub fields SF1 and SF2, and the remaining sub fields are the selective erasing sub field (ESF) whose address period is relatively short. It is thus possible to reduce the address period compared to the existing selective writing mode or SWSE mode. If the address period is reduced as such, a marginal time that the sustain period or additional sub fields can be positioned can be obtained.

The selective writing sub field (WSF), however, consists of sub fields of a low gray level whose luminance weight is low. Therefore, it has disadvantages that sustain discharge is unstable and subsequent discharge of the selective writing sub field (WSF) can be instable. In other words, assuming that the luminance weight and the sustain pulse are coincident, two sustain pulses are 2 in the second sub field SF2 of the last sub field of the selective writing sub field (SWF). It is difficult to stabilize the sustain discharge. Also, subsequent address discharge of the selective erasing sub field may become unstable. On the contrary, the luminance weight of 25(32) is assigned to the last sub field of the selective writing sub field in the existing SWSE mode, so that the number of the sustain pulse is 32. As a result, sustain discharge can occur in a stable state.

Figure 5:
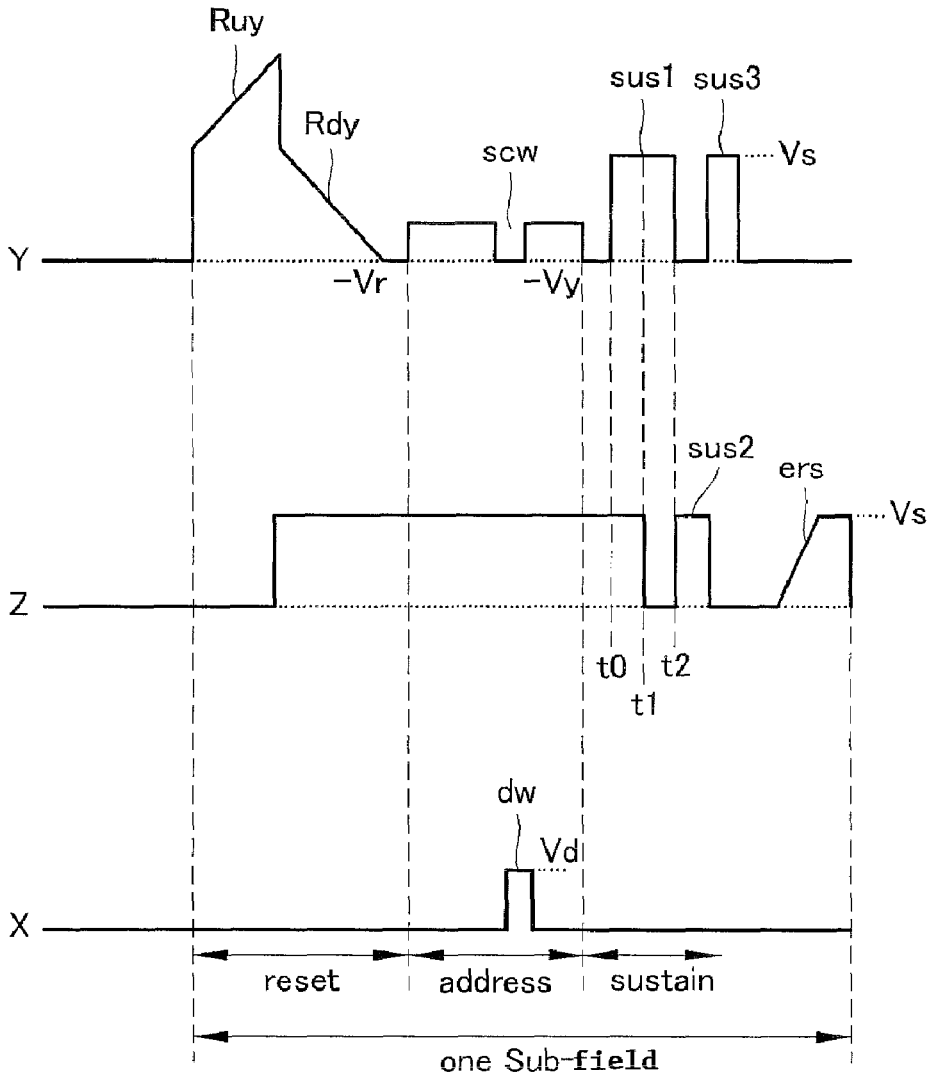
FIG. 5 shows a waveform illustrating a method for driving a plasma display panel according to an embodiment of the present invention.

In the method and apparatus for driving the PDP according to the present invention, discharge is stabilized by applying the driving waveform as shown in FIG. 5 to the PDP in each selective writing sub field (WSF) to which a low luminance weight is assigned.

Referring to FIG. 5, during the reset period of the selective writing sub field (WSF), a ramp waveform (Ruy) of inclination where a voltage rises up to a setup voltage (Vsetup) is applied to all the scan electrodes Y at the same time. At the same time, 0V or a ground voltage GND is applied to the address electrodes X and the sustain electrodes Z. Writing dark discharge is generated within cells of the entire screen between the scan electrodes Y and the address electrodes X and between the scan electrodes Y and the sustain electrodes Z by means of the rising ramp waveform (Ruy).

By means of the writing dark discharge, wall charges of the positive polarity (+) are accumulated on the address electrodes X and the sustain electrodes Z, and wall charges of the negative polarity (−) are accumulated on the scan electrodes Y. After the writing dark discharge is generated, a ramp waveform (Rdy) of falling inclination where a voltage decreases from the sustain voltage (Vs) to the ground voltage GND or 0V or the negative polarity voltage (−Vr) is applied to the scan electrodes Y. At the same time, a DC bias voltage (DCz) of the sustain voltage (Vs) is applied to the sustain electrodes Z.

Erasing dark discharge occurs between the scan electrodes Y and the sustain electrodes Z and between the scan electrodes Y and the address electrodes X, by means of a voltage difference between the falling ramp waveform (IRdy) and the DC bias voltage (DCz).

The erasing dark discharge serves to erase redundant wall charges that do not contribute to address discharge, among the wall charges generated by the rising ramp waveform (Rdy), thus making the wall charges uniformly remain within the cells of the entire screen.

During the address period of the selective writing sub field (WSF), a writing scan pulse (scw) of a scan voltage (−Vy) of the negative polarity is sequentially applied to the scan electrodes Y. At the same time, a writing data pulse (dw) of a data voltage (Vd) of the positive polarity synchronized to the writing scan pulse (scw) is applied to the address electrodes X. Furthermore, a DC bias voltage (DCz) of a sustain voltage (Vs) of the positive polarity is applied to the sustain electrodes Z.

As the voltage difference between the writing scan pulse (scw) and the writing data pulse (dw) and the wall voltage initialized during the reset period are added, writing discharge occurs within an on-cell to which the writing data pulse (dw) is applied. By means of the writing discharge, the polarity of the wall charges is reversed to the positive polarity as wall charges of the positive polarity are accumulated on the scan electrodes Y. As a result, wall charges of the negative polarity are accumulated on the sustain electrodes Z and the address electrodes X.

At the initial stage of the sustain period from the end point of the address period to t0, the ground voltage GND or 0V is applied to the scan electrodes Y and the address electrodes Z. Further, during this period, the DC bias voltage (DCz) of the sustain voltage (Vs) is continuously applied to the sustain electrodes Z.

In the sustain period, during the period from the point t0 to a point t2, a first sustain pulse (sus1) is applied to the scan electrodes Y, and the ground voltage GND or 0V is applied to the address electrodes X. During the period from the point t0 to a point t1 corresponding to an approximate former ½ period of the first sustain pulse (sus1), the DC bias voltage (DCz) of the sustain voltage (Vs) is continuously applied to the sustain electrodes Z.

In other words, during the period from the point t0 to the point t1, the sustain voltage (Vs) of the positive polarity is applied to the scan electrodes Y and the sustain electrodes Z at the same time. Thereafter, during the period from the point t1 to the point t2 corresponding to an approximate latter ½ of the first sustain pulse (sus1), the ground voltage GND or 0V is applied to the sustain electrodes Z. During the period from the point t1 to the point t2, as the wall voltage within the cell and the voltage of the sustain pulse are added, first sustain discharge occurs between the scan electrodes Y and the sustain electrodes z.

Figure 6A:
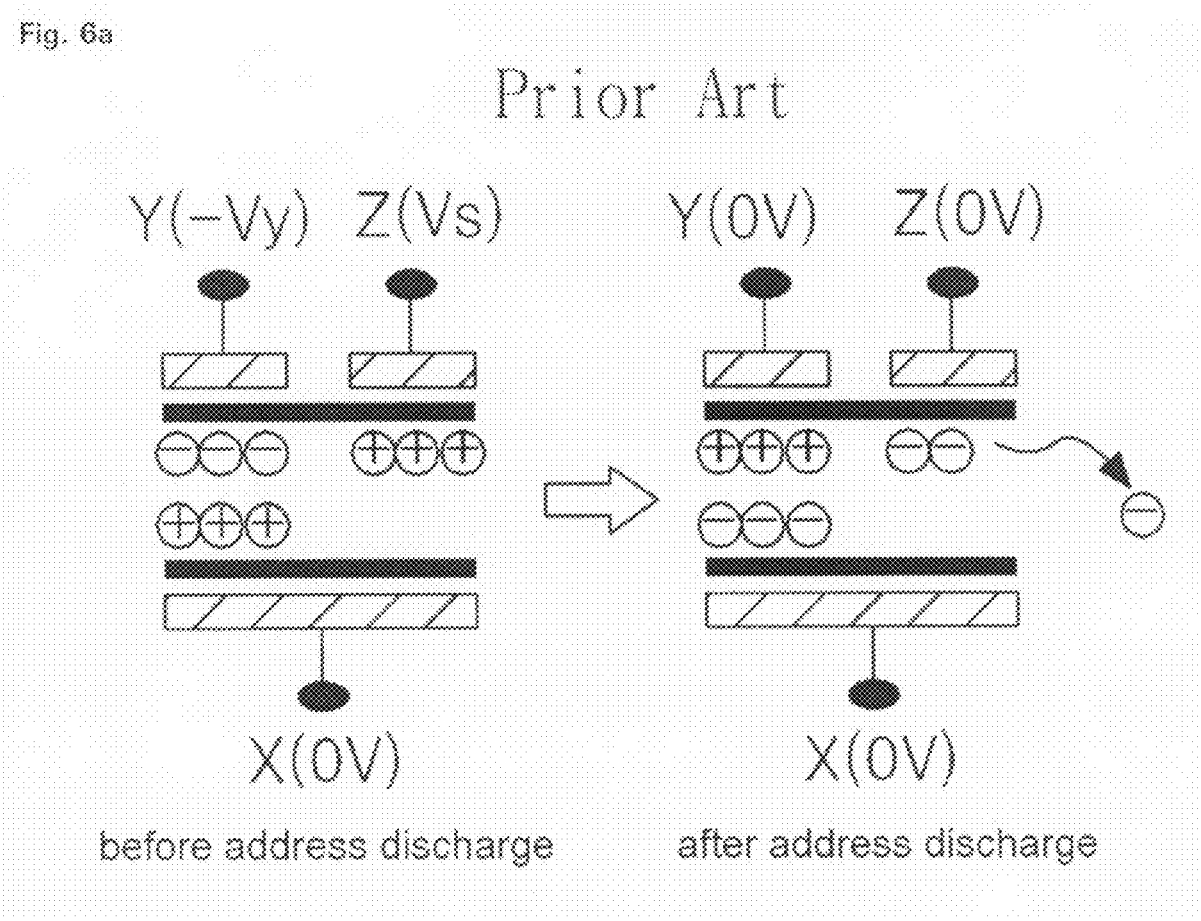
FIG. 6*a* shows the distribution of wall charges distribution before and after address discharge when the conventional driving waveform as shown in FIG. 3 is supplied to a PDP.
Figure 6B:
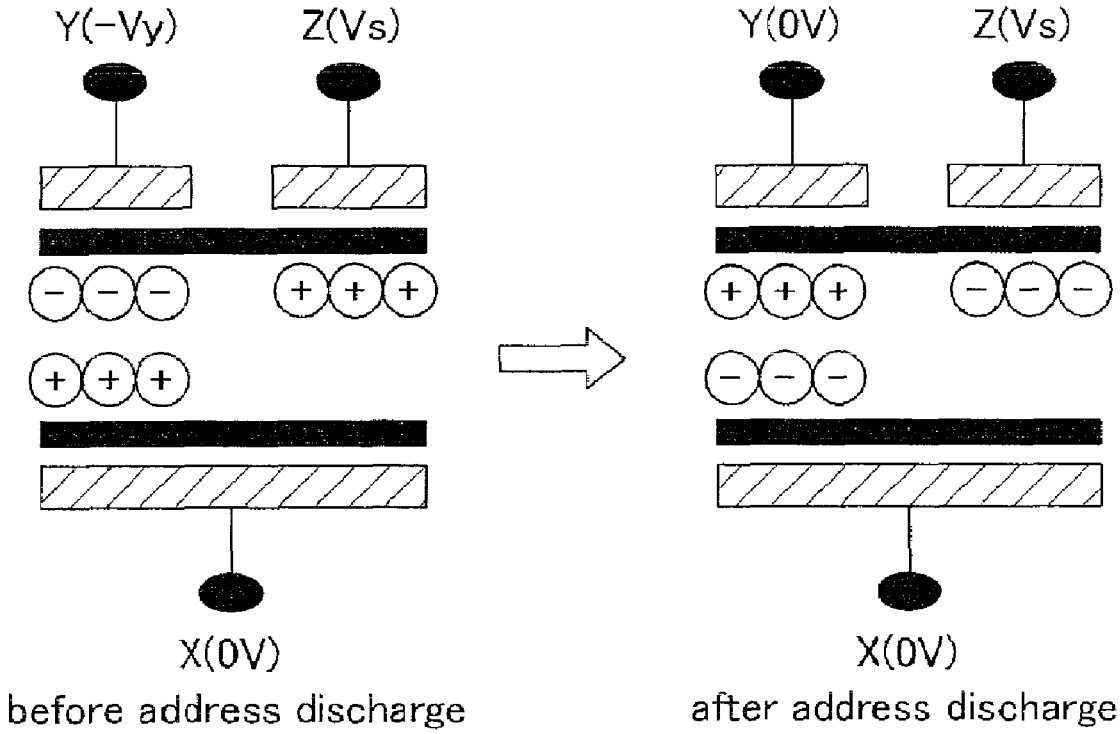
FIG. 6*b* shows the distribution of wall charges before and after address discharge when the driving waveform of the present invention as shown in FIG. 5 is supplied to a PDP.

During the period from the point t0 to the point t1, the first sustain pulse (sus1) is applied to the scan electrodes Y, but the voltage difference does not occur between the scan electrodes Y and the sustain electrodes Z. The period from the point t0 to the point t1 serves to prevent the wall charges of the negative polarity on the sustain electrodes Z from being delayed or lost by maintaining the voltage on the sustain electrodes Z in the sustain voltage (Vs) of the positive polarity, as shown in FIG. 6*b*.

Figure 1:
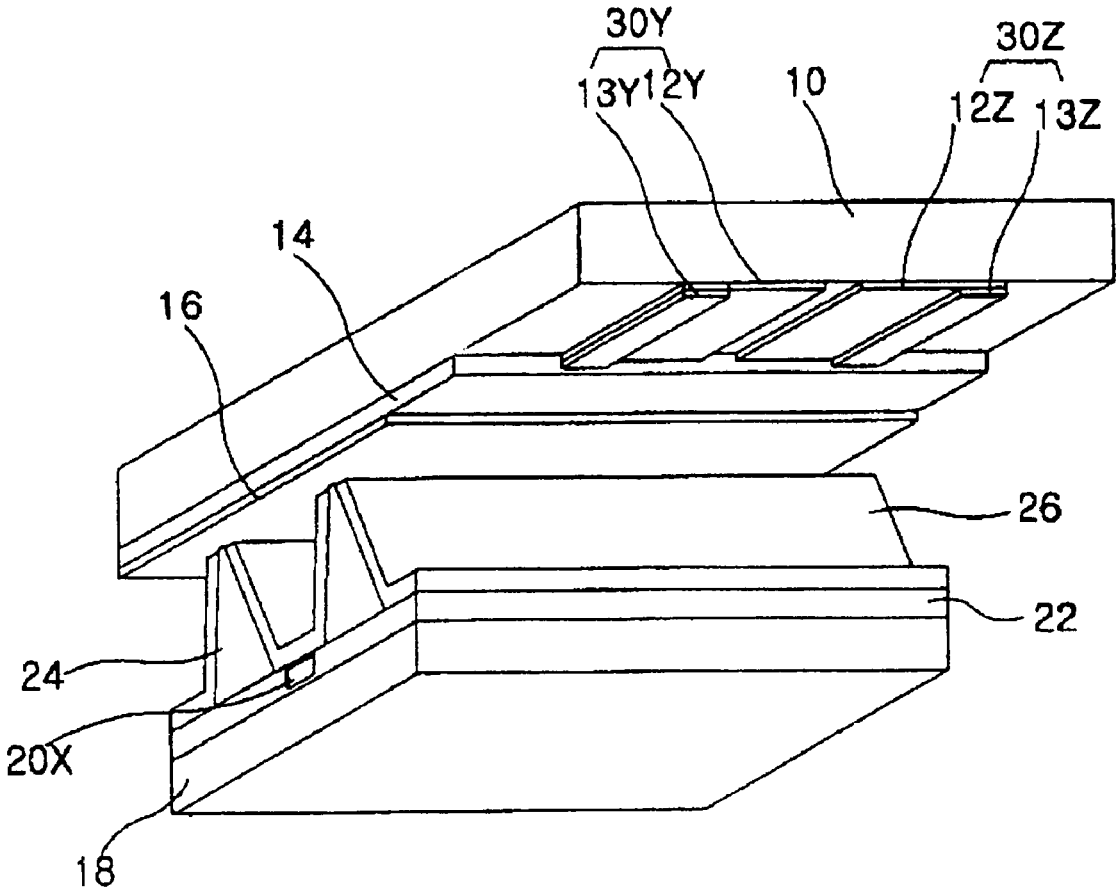
FIG. 1 is a perspective view illustrating the structure of a discharge cell in a three-electrode AC surface discharge type plasma display panel in the related art.
Figure 2:
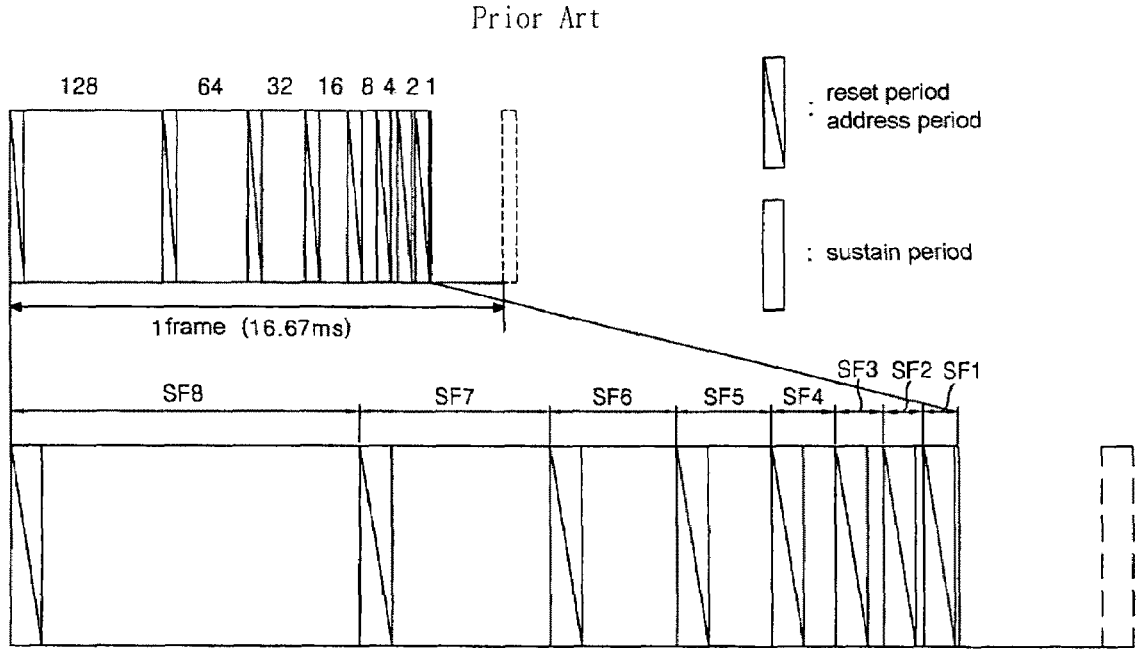
FIG. 2 shows a sub field pattern of a frame period in a method for driving a plasma display panel according to a prior art.
Figure 3:
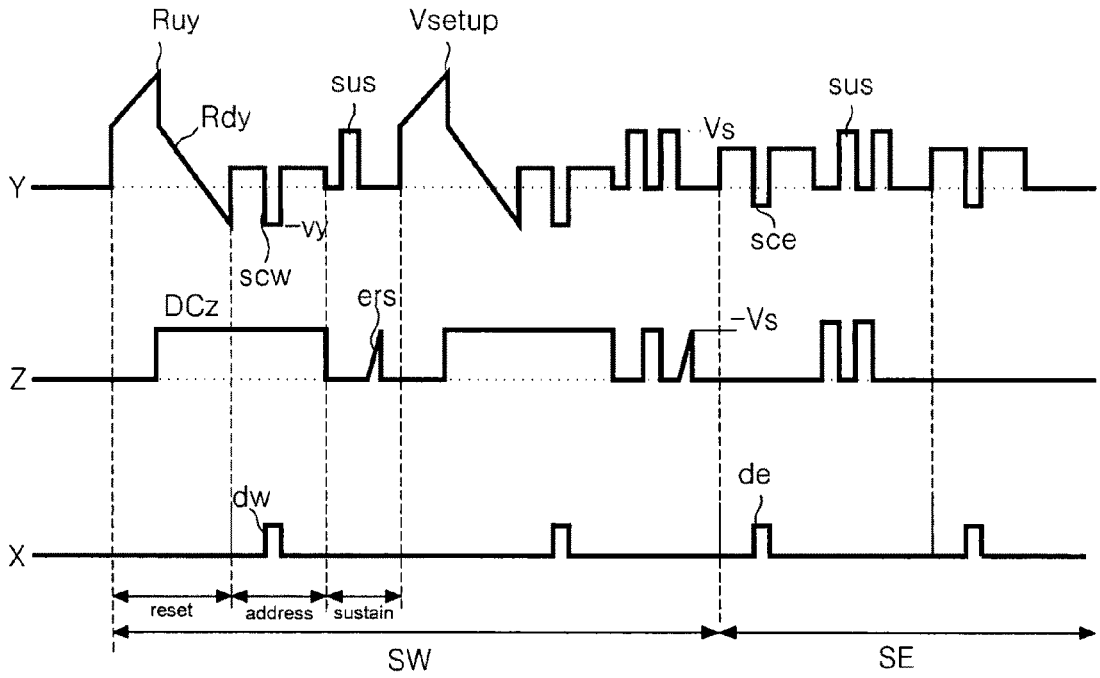
Fig. 3 Prior Art
FIG. 3 shows a waveform illustrating a driving waveform applied to a conventional SWSE mode.

This will be described in detail in conjunction with FIG. 6*a* and FIG. 6*b*. In the conventional selective writing sub field (SW) as shown in FIG. 3, if the address period is finished, that is, if address discharge is finished, the ground voltage GND or 0V is applied to the scan electrodes Y and the sustain electrodes Z at the same time. In this case, as the positive polarity voltage applied to the sustain electrodes Z decreases to the ground voltage GND or 0V, an absorption electrostatic force between the sustain electrodes Z and the negative polarity wall charges is reduced. Some of the negative polarity wall charges on the sustain electrodes Z can fall apart, as shown in FIG. 6*a*. In this case, when the first sustain pulse is applied to the scan electrodes Y, sustain discharge may not occur because the voltage difference between the scan electrodes Y and the sustain electrodes Z is not sufficient high.

On the contrary, in the method and apparatus for driving the PDP according to an embodiment of the present invention, if the address period is finished, only the voltage of the scan electrodes Y decreases to the ground voltage GND or 0V, but the voltage of the sustain electrodes Z maintains the sustain voltage (Vs) of the positive polarity. The absorption electrostatic force between the sustain electrodes Z and the wall charges of the negative polarity are kept high by means of the sustain voltage (Vs) of the positive polarity applied to the sustain electrodes Z during the period from the point t0 to the point t1. Thus, the wall charges of the negative polarity on the sustain electrodes Z are not lost, as shown in FIG. 6*b*. Accordingly, during the period from the point t1 to the point t2 where the first sustain pulse is applied to the scan electrodes Y, the voltage difference between the scan electrodes Y and the sustain electrodes Z becomes sufficiently high, so that sustain discharge occurs stably.

Following the point t2 of the sustain period, sustain pulses (sus2 and sus3) of a normal pulse width are alternately applied to the sustain electrodes Z and the scan electrodes Z. The ground voltage GND or 0V is continuously applied to the address electrodes X. Whenever the sustain pulse (sus) is applied as such, sustain discharge occurs in a selected on-cell during the writing address period.

After the last sustain discharge occurs, an erasing ramp waveform (ers) that gradually rises to the sustain voltage (Vs) is supplied. By means of the erasing ramp waveform (ers), wall charges generated by the sustain discharge are erased within the on-cell while erasing discharge occurs within the on-cell.

The scan driving unit 35 continuously supplies the rising lamp-ramp waveform (Ruy) and the falling ramp waveform (Rdy) as shown in FIG. 5 to the scan electrodes Y during the reset period of the selective writing sub field (WSF), and sequentially supplies the writing scan pulse (scw) to the scan electrodes Y during the address period of the selective writing sub field (WSF), under the control of the timing controller 37. During the sustain period of the selective writing sub field (WSF), the scan driving unit 35 continuously supplies the sustain pulses (sus1 and sus3) as shown in FIG. 5 to the scan electrodes Y. In addition, the scan driving unit 35 sequentially supplies the erasing scan pulse (sce) as shown in FIG. 3 to the scan electrodes Y during the erasing address period of the selective erasing sub field (ESF) and continuously supplies the sustain pulse (sus) as shown in FIG. 3 during the sustain period of the selective erasing sub field (ESF), under the control of the timing controller 37.

The sustain driving unit 36 supplies the DC bias voltage (DCz) to the sustain electrodes Z from the point where the falling ramp waveform (Rdy) of the reset period of the selective writing sub field (WSF) to the point t1, and continuously supplies the sustain pulse (sus2) and the erasing ramp waveform (ers) to the sustain electrodes Z from the point t2 to the point where the sustain period ends in FIG. 5, under the control of the timing controller 37. In addition, the sustain driving unit 36 supplies the ground voltage GND or 0V to the sustain electrodes Z during the erasing address period of the selective erasing sub field (ESF), and supplies the sustain pulse (sus) to the sustain electrodes Z during the sustain period of the selective erasing sub field (ESF), under the control of the timing controller 37 as shown in FIG. 3.

The driving waveform of the selective erasing sub field (ESF) is substantially the same as that shown in FIG. 3.

Figure 7:
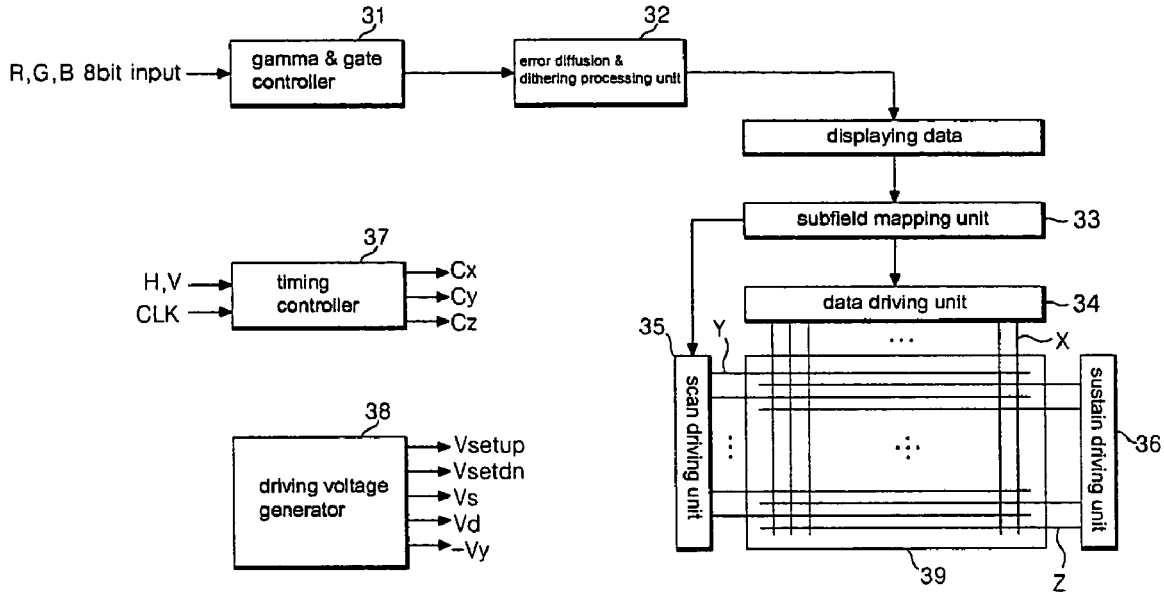
FIG. 7 is a block diagram illustrating an apparatus for driving a PDP according to an embodiment of the present invention.

FIG. 7 is a block diagram illustrating the driving apparatus of a plasma display panel according to an embodiment of the present invention.

Referring to FIG. 7, the apparatus for driving the PDP according to an embodiment of the present invention includes a data processing unit having a gamma & gate controller 31, an error diffusion & dithering processing unit 32 and a sub field mapping unit 33, a data driving unit 34 for providing data to address electrodes X of a PDP 39, a scan driving unit 35 for driving scan electrodes Y of the PDP, a sustain driving unit 36 for driving sustain electrodes Z of the PDP 39, a timing controller 37 for generating a timing control signal necessary to drive each driving circuit, thus controlling each driving circuit, and a driving voltage generator 38 for generating a driving voltage necessary for the PDP 39.

The gamma & gate controller 31 corrects gamma and a gain for a digital video data (RGB) from the input line.

The error diffusion & dithering processing unit 32 diffuses quantization error components of the digital video data (RGB) inputted from the gamma & gate controller 31 into neighboring pixel data using a Floyd-Steinberg error diffusion filter, etc. and thus dithers error components. Furthermore, the error diffusion & dithering processing unit 32 thresholds and dithers the input data using a mask (or dither matrix) whose threshold value is set corresponding to each pixel. The error diffusion & dithering processing unit 32 Expands the range of the gray level that can be represented in a sub field pattern by representing the gray level of a half level.

The sub field-mapping unit 33 maps data received from the error diffusion & dithering processing unit 32 to the sub field pattern as shown in FIG. 4.

The data driving unit 34 supplies data received from the sub field-mapping unit 33 to the address electrodes X under the control of the timing controller 37.

The scan driving unit 35 continuously supplies the rising ramp waveform (Ruy) and the falling ramp waveform (Rdy) as shown in FIG. 5 to the scan electrodes Y during the reset period of the selective writing sub field (WSF), and sequentially supplies the writing scan pulse (scw) to the scan electrodes Y during the address period of the selective writing sub field (WSF), under the control of the timing controller 37. During the sustain period of the selective writing sub field (WSF), the scan driving unit 35 continuously supplies the sustain pulses (sus1 and sus3) as shown in FIG. 5 to the scan electrodes Y. In addition, the scan driving unit 35 sequentially supplies the erasing scan pulse (sce) as shown in FIG. 3 to the scan electrodes Y during the erasing address period of the selective erasing sub field (ESF) and continuously supplies the sustain pulse (sus) as shown in FIG. 3 during the sustain period of the selective erasing sub field (ESF), under the control of the timing controller 37. The sustain driving unit 36 supplies the DC bias voltage (DCz) to the sustain electrodes Z from the point where the falling ramp waveform (Rdy) of the reset period of the selective writing sub field (WSF) to the point t1, and continuously supplies the sustain pulse (sus2) and the erasing ramp waveform (ers) to the sustain electrodes Z from the point t2 to the point where the sustain period ends in FIG. 5, under the control of the timing controller 37. In addition, the sustain driving unit 36 supplies the ground voltage GND or 0V to the sustain electrodes Z during the erasing address period of the selective erasing sub field (ESF), and supplies the sustain pulse (sus) to the sustain electrodes Z during the sustain period of the selective erasing sub field (ESF), under the control of the timing controller 37 as shown in FIG. 3.

The timing controller 37 uses vertical/horizontal synchronization signals (V and H) and a clock signal (Clk) to generate timing control signals (Cx, Cy and Cz) necessary for the respective driving units 34, 35 and 36, and supplies the timing control signals (Cx, Cy and Cz) to the respective driving units 34, 35 and 36, thus controlling the respective units 34, 35 and 36.

The data control signal (Cx) contains a sampling clock for sampling data, a latch control signal, an energy recovery circuit, and a switch control signal for controlling an on/off time of the driving switch device. The scan control signal (Cy) contains a switch control signal for controlling an on/off time of an energy recovery circuit and a driving switch device within the scan driving unit 35. Further, the sustain control signal (Cz) contains a switch control signal for controlling the on/off time of the energy recovery circuit and a driving switch device within the sustain driving unit 36.

The driving voltage generator 38 generates a voltage (Vsetup) of a rising lamp ramp waveform (Ruy), a voltage (Vsetdn) of a falling ramp waveform (Rdy), a scan voltage (−Vy), a sustain voltage (Vs), a data voltage (Vd) and so on. These driving voltages can be changed depending on the composition of a discharge gas or the structure of a discharge cell.

As described above, according to a method and apparatus for driving a PDP of the present invention, a selective writing sub field of a SWSE mode is allocated to a sub field of a low gray level and the remaining sub fields are allocated to selective erasing sub fields whose address period is short. It is thus possible to reduce an address period. After the address period of the selective writing sub field is finished, a voltage on scan electrodes is lowered, whereas a voltage on sustain electrodes keeps a positive polarity voltage. Accordingly, it is possible to stabilize discharge of a selective erasing sub field followed by sustain discharge.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving a plasma display panel by time-dividing one sub-field into a reset period, an address period and a sustain period, wherein the plasma display panel includes a plurality of scan electrodes, a plurality of sustain electrodes and a plurality of address electrodes, the method comprising:

supplying a scan pulse to the scan electrodes and a data pulse to the address electrodes to select a cell during the address period;

supplying a DC bias voltage to the sustain electrodes during the address period;

supplying a sustain pulse alternately to the scan electrodes and the sustain electrodes after the address period; and supplying the DC bias voltage to the sustain electrodes while the sustain pulse is supplied to the scan electrodes, wherein the scan electrodes are maintained at a ground voltage before a first sustain pulse is supplied to the scan electrodes.

2. The method of claim 1, wherein a plurality of remaining sustain pulses are supplied to the scan electrodes after the first sustain pulse during the sustain period, wherein a width of the first sustain pulse is greater than a width of each of the plurality of remaining sustain pulses.

3. The method of claim 1, further comprising supplying a rising ramp waveform and a falling ramp waveform to the scan electrodes during the reset period.

4. An apparatus for driving a plasma display panel by time-dividing one sub-field into a reset period, an address period and a sustain period, wherein the plasma display panel includes a plurality of scan electrodes, a plurality of sustain electrodes and a plurality of address electrodes, the apparatus comprising:

a scan driving unit for supplying a scan pulse to the scan electrodes during the address period and a sustain pulse to the scan electrodes after the address period;

a sustain driving unit for supplying a DC bias voltage to the sustain electrodes during the address period and for supplying the DC bias voltage to the sustain electrodes while the sustain pulse is supplied to the scan electrodes, wherein the scan electrodes are maintained at a ground voltage before a first sustain pulse is supplied to the scan electrodes.

5. The apparatus of claim 4, wherein the scan driving unit supplies a plurality of remaining sustain pulses to the scan electrodes after the first sustain pulse during the sustain period, wherein a width of the first sustain pulse is greater than a width of each of the plurality of remaining sustain pulses.

6. The apparatus of claim 4, wherein the scan driving unit supplies a rising ramp waveform and a falling ramp waveform to the scan electrodes during the reset period.

7. A method of driving a plasma display panel selecting discharge cells using selective writing sub-fields and selective erasing sub-fields arranged within one frame period, wherein the plasma display panel includes a plurality of scan electrodes, a plurality of sustain electrodes and a plurality of address electrodes, the method comprising:

supplying a scan pulse to the scan electrodes and a data pulse to the address electrodes to select a cell, and supplying a DC bias voltage to the sustain electrodes during address period within at least one of the selective writing sub-fields and the selective erasing sub-fields;

supplying a sustain pulse to the scan electrodes during a beginning of a sustain period of the selective writing sub-fields; and supplying the DC bias voltage to the sustain electrodes while a first sustain pulse is supplied to the scan electrodes during the beginning of the sustain period of the selective writing sub-fields.

8. The method of claim 7, wherein the selective writing sub-fields are arranged in sub-fields with a low gray level and the selective erasing sub-fields are arranged in sub-fields with a high gray level.

9. The method of claim 7, wherein a plurality of remaining sustain pulses are supplied to the scan electrodes after the first sustain pulse during the sustain period, wherein a width of the first sustain pulse is greater than a width of each of the plurality of remaining sustain pulses.

10. The method of claim 7, further comprising supplying a rising ramp waveform and a falling ramp waveform to the scan electrodes during the reset period.

11. The method of claim 7, wherein the scan electrode is maintained at a ground voltage during the sustain period before the first sustain pulse is supplied to the scan electrodes.

12. The method of claim 7, wherein the DC bias voltage is supplied to the sustain electrodes while the first sustain pulse is supplied to the scan electrodes during the beginning of the sustain period of the selective writing sub-fields arranged just before the selective erasing sub-fields.

* * * * *